US006543932B1

(12) United States Patent
Potter et al.

(10) Patent No.: US 6,543,932 B1
(45) Date of Patent: Apr. 8, 2003

(54) ENTHALPY TUNNEL

(76) Inventors: Jan Fredrick Potter, 51336 Hunting Ridge Trail, Granger, IN (US) 46530; Robert Scott Risk, 1436 Silverbrook La., St. Joseph, MI (US) 49085; Alvin Andrew Potter, 185 Glen Riddle Rd., Media, PA (US) 19036

( * ) Notice: Subject to any disclaimer, the term of this patent is extended or adjusted under 35 U.S.C. 154(b) by 178 days.

(21) Appl. No.: 09/587,822

(22) Filed: Jun. 6, 2000

(51) Int. Cl.[7] ..... G01K 17/00; F25B 49/00

(52) U.S. Cl. ..... 374/29; 374/10; 374/30; 700/276; 702/182

(58) Field of Search ..... 700/278, 276, 700/275; 702/182, 185; 374/29, 10, 30; 165/251, 236

(56) References Cited

U.S. PATENT DOCUMENTS 4,517,837 A * 5/1985 Oyama et al. ..... 73/118.2
4,668,102 A * 5/1987 Mott ..... 374/138
4,672,560 A 6/1987 Katayama et al.
4,672,561 A 6/1987 Katayama et al.
4,718,456 A * 1/1988 Schoonover ..... 137/625.37
4,836,096 A * 6/1989 Avery ..... 165/246
5,026,171 A * 6/1991 Feller ..... 374/40
5,048,327 A * 9/1991 Atwood ..... 73/118.2
5,073,862 A 12/1991 Carlson
5,369,597 A 11/1994 Bujak, Jr.
5,467,287 A 11/1995 Wenner et al.
5,520,048 A * 5/1996 Traina et al. ..... 374/148
5,746,061 A * 5/1998 Kramer ..... 374/39

OTHER PUBLICATIONS

ANSI/ASHRAE Standard 37–1988.*

* cited by examiner

*Primary Examiner*—Leo Picard
*Assistant Examiner*—Alexander Kosowski
(74) *Attorney, Agent, or Firm*—Benjamin A. Randall

(57) ABSTRACT

An improved and accurate enthalpy tunnel is presented, designed to condition and control airflow patterns within the main tunnel and air sampling subsystem so as to present a homogenous volume immediately upon introduction into the enthalpy tunnel. The air volume velocity is slowed and the air volume is completely mixed in a settling chamber which also serves to maintain the static discharge pressure on the unit under test. The rectangular design in use in the industry is replaced with circular geometry, using a cylindrical tunnel shape as opposed to a rectangular shape. The circular geometry creates a flat, uniform velocity profile. This tunnel improves the design of current art enthalpy tunnels by using a single nozzle instead of a bank of nozzles, presenting to the sampling mechanism a smooth, stable and uniform flow profile. The sampling method used in the prior art is replaced with a sampling tunnel that also conditions its air flow profile, leading to consistent sampling. Means for controlling the air velocity and mass flow rate in both the main tunnel and the sampling tunnel in real time during the performance of a test, using a feedback loop controller for both the sampling and main tunnels, and by providing variable flow rate discharge mechanisms is provided.

19 Claims, 10 Drawing Sheets

ENTHALPY TUNNEL

CROSS REFERENCE TO RELATED APPLICATIONS

Not Applicable

FEDERALLY SPONSORED RESEARCH OR DEVELOPMENT

Not Applicable

REFERENCE TO MICROFICHE APPENDIX

Not Applicable

BACKGROUND OF THE INVENTION

This invention relates in general to devices used for measuring the change in enthalpy of an air stream from preconditioned to conditioned states. In particular, this invention is a device for determining the rating of air conditioning or forced air heating units (hereinafter "air-conditioning units"), using the change in enthalpy between entry and exit air streams.

SPECIFIC PROBLEMS IN THE PRIOR ART

A class of devices for determining the rating of air conditioners and heaters is known in the art as enthalpy tunnels or code testers. The basic design of an enthalpy tunnel is described in the American Society of Heating, Refrigeration and Air Conditioning Engineers, (ASHRAE) Standard 37-1988, *Methods of Testing for Rating Unitary Air-Conditioning and Heat Pump Equipment,* the disclosure therein hereby incorporated by reference. Enthalpy tunnel tests measure wet and dry bulb temperatures of entry and exit air from air-conditioning units and determine the enthalpy of the air mass in both conditions. These measurements allow the difference in enthalpy between the entry and exit air masses to be calculated. The enthalpy difference, combined with the mass flow rate of the air is then used to determine the amount of work the air conditioner or heater has performed.

ASHRAE Standard 37-1988 provides the general requirements of an enthalpy tunnel and further provides tolerances and standards for associated instrumentation and ancillary equipment. However, the Standard provides only general guidelines for the structure of an enthalpy tunnel, not a specific design.

In general, enthalpy tunnel testing units consist of an indoor room containing the heating or cooling coil and the test equipment, and an outdoor room containing the compressor and diffusor unit, such an arrangement usually referred to as a test cell. The indoor and outdoor rooms are thermally separated; waste heat generated by the air-conditioning unit exhausted to the outside room, and ultimately to the atmosphere. The enthalpy tunnel is connected to the heating or cooling coil under test by means of duct-work, and a controlled, measured mass of air is directed across the coil. The enthalpy tunnel accomplishes three goals: (1) It controls and measures the flow rate of air through the heating or cooling coil; (2) It controls the static pressure drop across the heating or cooling coil, and (3) It measures the exit temperature and humidity of the air volume exiting the heating or cooling coil being tested.

The exit temperature and humidity combined with the exit volumetric airflow rate yields the exit mass flow and enthalpy of the conditioned air. The inlet temperature and humidity combined with the same mass flow rate for the exit yields the unit inlet enthalpy of the air. The difference between the two is the work performed by the unit. The same mass flow rate inlet and outlet, along with the energy calculations, is an expression of the First Law of Thermodynamics.

The guidelines given in ASHRAE Standard 37-1988 for the construction of an enthalpy tunnel are non-specific as to the physical structure of enthalpy tunnels but are suggestive. State of the art enthalpy tunnels follow this suggestion, and generally consist of a rectangular sheet metal tunnel with a series of diffusion screens and flow control devices. Current art enthalpy tunnels also use a bank of fixed nozzles for flow control, and static pressure control as suggested by the Standard.

In an enthalpy tunnel constructed in accordance with the ASHRAE Standard 37-1988, using the design suggested therein, conditioned air enters the tunnel and then passes through a diffusion screen to facilitate mixing and homogeneity of the air stream. The air then passes through a bank of fixed nozzles, used to create a pressure drop and, in enthalpy tunnels of current design, control volumetric flow rates and static pressure at the exit of the air conditioning unit under test. The pressure drop across the nozzle bank is measured by means of a draft-range differential pressure transmitter. The resulting information is used to determine a volumetric flow rate. The air stream is then passed through a second diffusion screen and then into a discharge chamber. The temperature and humidity of the exit air stream are measured by sampling the air at the entrance to or in the discharge chamber. FIG. 5 of ASHRAE Standard illustrates the suggested configuration of this type of enthalpy tunnel.

The sampled air is measured to determine wet and dry bulb temperatures. ASHRAE Standard 37-1988 requires that the air velocity over the wet bulb temperature measuring instrument be 1000 feet per minute (fpm.) Velocities above or below 1000 fpm require that the wet bulb measurements be corrected in accordance with ASHRAE Standard 41.1-1986, the disclosure therein hereby incorporated by reference. Current art enthalpy tunnels have no reliable method for insuring that this velocity is maintained. Consequently, a correction calculation is routinely performed, allowing more error to enter the calculated rating of the unit under test. Subsequent calculations using wet and dry bulb temperatures in conjunction with the volumetric flow rate, are used to calculate the mass flow rate and the work performed by the unit.

ASHRAE Standard 37-1988 also requires enthalpy tunnels to be equipped with a discharge fan to control the static discharge pressure of the air conditioning unit being tested, and for means to vary the capacity of the fan. Current art enthalpy tunnels use the fixed nozzle bank described above to control the amount of air that passes through the tunnel. Depending on the desired static discharge pressure required, nozzles are plugged or freed to restrict or increase flow, indirectly varying the discharge fan capacity, the flow through the tunnel and the static discharge pressure the unit under test sees.

This method of varying flow and controlling static pressure, although widely used, has undesirable effects on the air flow in the enthalpy tunnel, and on the accuracy of the measurements made using this method. The use of a nozzle bank, as suggested by the Standard, creates multiple jets in the downstream air mass. Flow rates could be set using any number of nozzle configurations, and nozzle configurations are not consistent from test to test. The velocity profile across the tunnel after the nozzle bank is extremely irregular. This irregularity is in part corrected by the use of a diffusion screen downstream of the nozzle bank, but testing has shown that the velocity profile is still far from flat even after passing through the downstream diffusion screen.

In general, the results of testing air conditioning units using this "plugged nozzle" method of varying air flow have been inconsistent, non-repeatable and inaccurate. Depending on what nozzles are plugged and due to the rectangular shape of the tunnels, unstable zones of re-circulation and varying pressure gradients are created. These unknown quantities cause errors in both flow and pressure readings, and result in non-homogenous temperature profiles within the air stream. As a result, the temperature of the air that is sampled is non-uniform, and results in erroneous calculations. In addition, the "plugged nozzle" method of setting volumetric flow rate and/or static pressure does not allow for modification of these parameters during a test run. Temperature and humidity changes can and do often occur during tests.

Measurements and tests conducted by the Applicants have shown that the air flow patterns downstream of fixed nozzle banks, are non-uniform even when no nozzles are plugged. The use of multiple nozzles creates downstream of the nozzle bank unstable laminar and turbulent flow regions. These regions are exaggerated and especially prevalent when nozzles are plugged to control the air flow rate. In addition to the non-uniform flow present in the main tunnel, the air sampling configurations presently being used produce uneven flow and pressure gradients within the sampling tubes themselves. Most current art enthalpy tunnels use a grid array of piping as a sample collection device. Usually the array is constructed using tubing or piping connected with tees and elbows. The tubing is perforated and the grid is attached to a sample fan or blower. The grid arrays generally have a series of holes drilled into the piping or tubing that are uniform in size and regular in placement. No effort is made to ensure that the volume of air sampled from every hole is the same, or that the sample as a whole is truly representative of the enthalpy conditions present in the air mass.

Inconsistent and non-repeatable results caused by the design flaws in the current in design of enthalpy tunnels have forced the industry to incorporate correction factors into the calculations using the data from current art enthalpy tunnels. The result of the inaccurate testing and calculations is that air conditioning units are placed into the stream of commerce without a truly accurate representation of their efficiency rating or capacity.

It is the current state of the art in enthalpy tunnels to operate them in test cells and in fixed locations. In general, test cells and enthalpy tunnels require that duct-work be routed from the unit under test to the tunnel, and often these routings take circuitous and tortuous paths. A tunnel design imparting some flexiblity in the location of the tunnel with respect to the unit being tested would further condition the air flow prior to its introduction into the tunnel.

SUMMARY OF THE INVENTION

An improved and accurate enthalpy tunnel is presented. The present invention overcomes limitations in the prior art enthalpy tunnels, whose designs do not attempt to condition and control the airflow patterns within the main tunnel and air sampling subsystem. The present invention replaces the ASHRAE Standard 37-1988 suggested configuration, which is widely used without modification by the industry, with a design that meets the requirements of the Standard and provides consistent, controlled repeatable results. The test results from this enthalpy tunnel may be used without "correction factors" as a true and accurate measure of the capacity of a tested air-conditioning unit.

The present invention departs from the current art design of enthalpy tunnels by conditioning the air mass flow rate so as to present a homogenous volume immediately upon introduction into the enthalpy tunnel. The air volume velocity is slowed and the air volume is completely mixed in a settling chamber.

The present invention also replaces the rectangular design in use in the industry with circular geometry, using a cylindrical tunnel shape as opposed to the suggested rectangular shape. The circular geometry creates a flat, uniform velocity profile. The present invention improves the design of current art enthalpy tunnels by using a single nozzle instead of a bank of nozzles, presenting to the sampling mechanism a smooth, stable and uniform flow profile and circumventing the need for instrumentation calibration due to changes in nozzle configuration. The sampling method used in the prior art is replaced with a sampling tunnel that also conditions its air flow profile, leading to consistent sampling.

The present invention also provides means for controlling the air velocity and mass flow rate in both the main tunnel and the sampling tunnel in real time during the performance of a test, using a feedback loop controller for both the sampling and main tunnels, and by providing variable flow rate discharge mechanisms. These improvements over the current art generate predictable airflow, temperature and pressure profiles within the system, and consistent repeatable test results.

It is another improvement of the present invention over the prior art that only one diffusion screen need be used. Multiple screens are required where the fixed nozzle bank is used for flow control and determination because of the significant disruption of the air flow profile. The present invention provides a variable capacity discharge blower eliminating the need for plugged nozzle flow and control, and multiple diffusion screens.

DESCRIPTION OF THE PREFERRED EMBODIMENT

Figure 1:
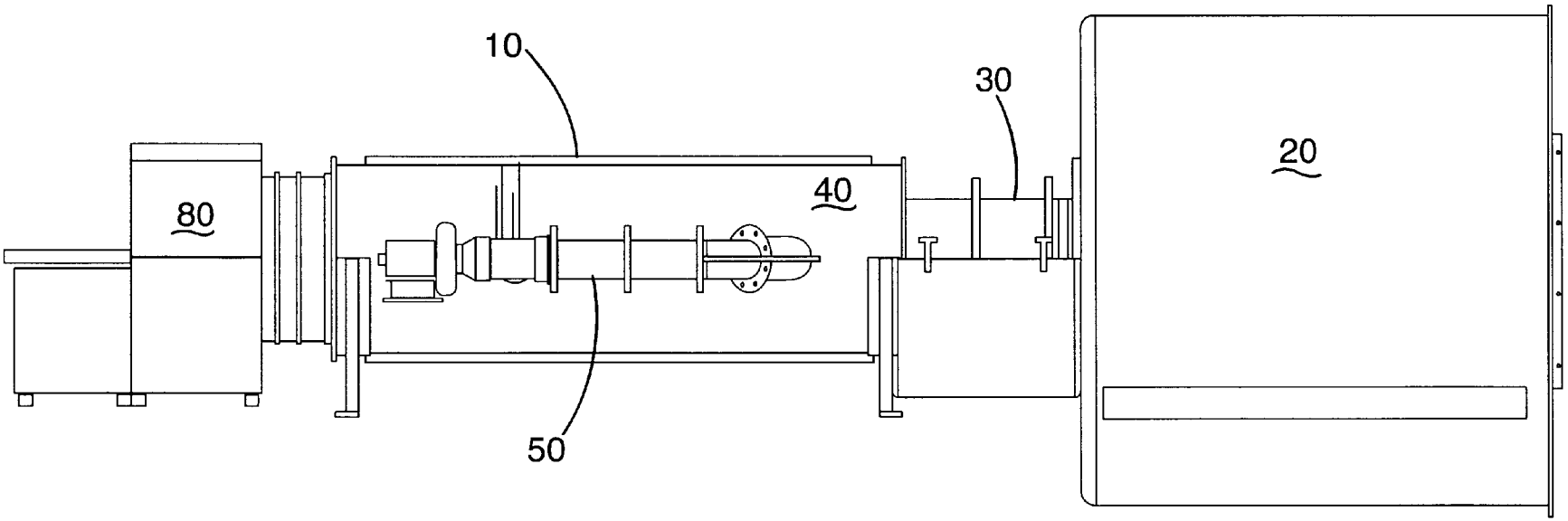
FIG. 1 is a schematic drawing of the preferred embodiment of the present invention illustrating the major components.

Referring to FIG. 1 the present invention, an enthalpy tunnel indicated generally at 10, may be seen. The enthalpy tunnel 10 comprises five major components: An interface/settling chamber 20, a main air flow sensor 30, a main tunnel 40, a sampling tunnel assembly 50, and a main blower assembly 80. It is important in all thermodynamic tests to ensure that heat losses are minimized. Therefore, in general, all duct-work used in conjunction with the present invention is insulated and sealed at the connection points with aluminum duct tape. In addition, all exterior surfaces of the enthalpy tunnel 10 are insulated to prevent heat loss or gain, or constructed from materials with a high R factor and that quickly approach thermal equilibrium.

The first major component a conditioned air stream encounters when passed through the enthalpy tunnel 10 is the interface/settling chamber 20. The interface/settling chamber 20 is a large substantially cylindrical volume having an inlet adapted to receiving an air stream via duct-work, an aerodynamically smooth outlet for presenting air to the main air flow sensor 30 and the main tunnel 40, and a large central volume. The large central volume allows the entering air stream's velocity to retard and to be thoroughly mixed.

In general, the air entering the interface/settling chamber 20 will either be pushed in by a blower integral to the air conditioning unit being tested, or will be pulled in by the main blower assembly 80. In either case, the entering air will have a positive velocity. The air stream, upon entering the interface/settling chamber 20 will tend to form a jet, and create areas of backflow and swirling. The purpose of the interface/settling chamber 20 is to condition the air stream so as to make it uniform and suitable for sampling without error. The size and shape of the interface/settling chamber 20 is chosen so that a particular mass flow rate of air will be conditioned to have a flat velocity profile across the cross section of the interface/settling chamber 20, and will be completely mixed.

Figure 2:
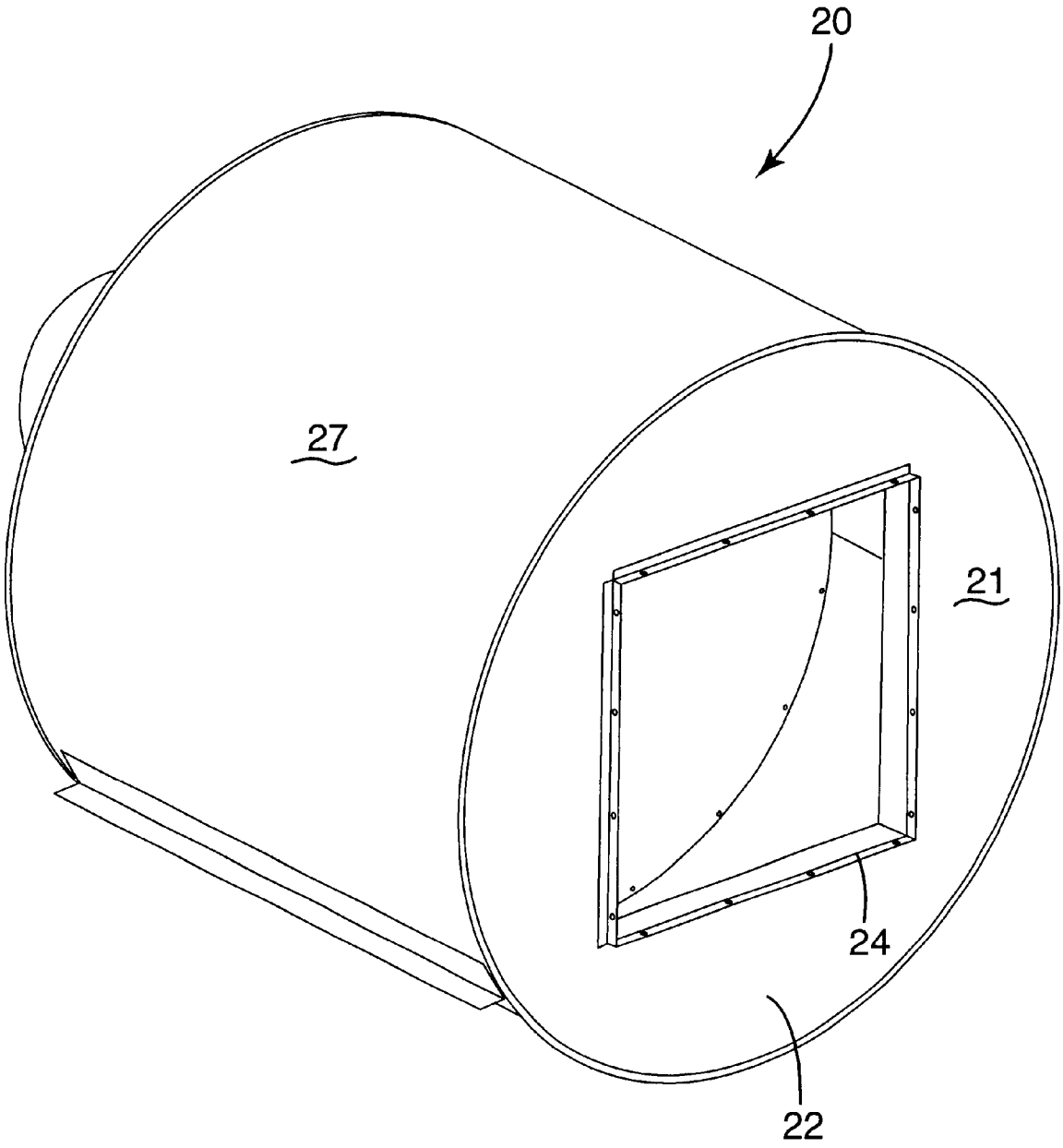
FIG. 2 is a isometric drawing of the interface/settling chamber.
Figure 3:
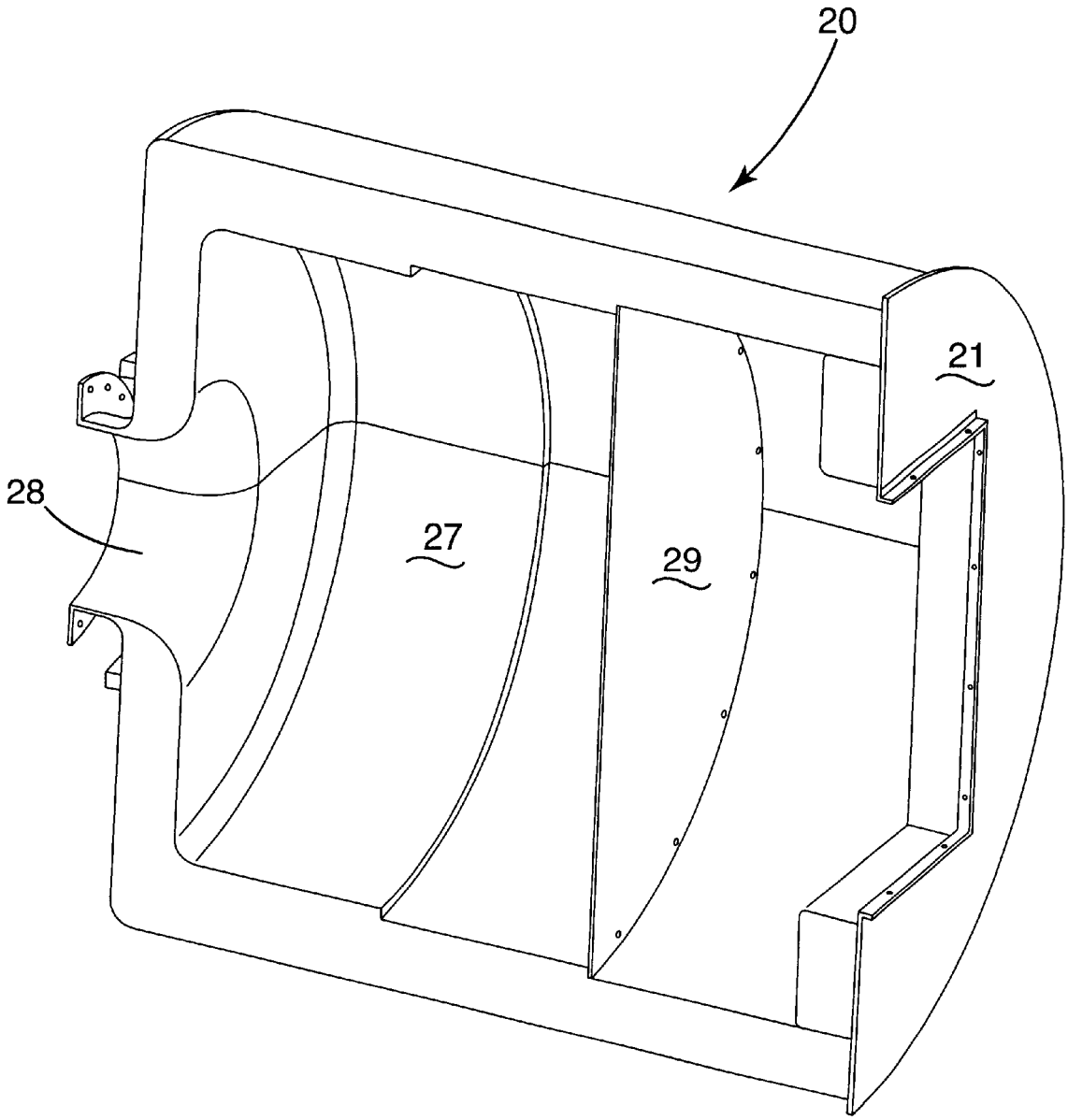
FIG. 3 is a sectional view of the interface/settling chamber.

Referring to FIGS. 2 and 3, the interface/settling chamber 20 is constructed as a series of cylinders of decreasing size, which are in turn constructed from two identical fiberglass molded halves secured together, the halves being bolted or otherwise secured together using flanges integrated into the mold along the edges. The series of decreasing cylinders provides a lip or flange at the connection point between the cylinders. This flange provides a convenient place to install diffusion screens.

The interface/settling chamber 20 serves three purposes. First, it acts as a universal interface structure allowing various size duct-work to be attached to the tunnel. As previously indicated, an air-conditioning unit under test will be attached to the enthalpy tunnel 10 via duct-work. The interface/settling chamber 20 comprises an entrance plate assembly 21, a main body 27, and an aerodynamically bell shaped exit nozzle 28. The entrance plate assembly 21 consists of a circular plate 22 having a centrally located opening 23. The opening 23 is surrounded by a clip assembly 24. The clip assembly 24 allows the insertion and capture of duct work.

The second purpose of the interface/settling chamber 20 is to retard the inlet air velocity to near zero, and conditioning the velocity flow profile. Conditioned air leaving the unit under test exits the unit, enters the connecting duct-work and passes through the opening 23 with a positive velocity. The unit under test may or may not have a discharge blower of its own. The interface/settling chamber 20 provides a volume of sufficient size and shape to retard the air stream velocity immediately after exiting the entrance plate assembly 21 and entering the interface/settling chamber 20. The purpose of the interface/settling chamber 20 is to allow the air stream to approach zero velocity as close as practical for a given mass flow rate, to completely mix the air volume, and to condition the air stream so it has a flat velocity profile. In the preferred embodiment, the interior volume of the interface/settling chamber 20 is sized to accommodate an air flow up to and including 10,000 SCFM. For larger flow rates, it is anticipated that larger volume settling chambers can be used.

In the preferred embodiment, a circular cross sectional area was chosen for the interface/settling chamber 20. It is essential to create a mass flow rate of air that is completely mixed and that has a flat velocity profile. The use of a circular, or near circular geometry yields the flattest velocity profile. However, other cross-sectional shapes will also provide acceptable results. In general, the smoother the interior surface and the fewer corners the air encounters, the flatter the velocity profile. A circular cross section approaches a flat velocity profile more quickly for a given velocity than other shapes, and it is therefore more efficient to use a circular geometry.

After entering the interface/settling chamber 20 through the opening 23, the air stream first expands and the air velocity nears zero. The air mass then passes through a diffusion screen 29. The purpose of the diffusion screen is to help ensure a homogenous air volume by disrupting the flow profile of the air entering settling chamber and by enhancing mixing. Diffusions screens such as the ones used in the present invention are well known in the art. ASHRAB Standard 37-1988 provides requirements for the number, placement and open area required of the screens.

The third purpose of the interface/settling chamber 20 is to provide a single aerodynamically smooth, bell shaped exit opening for the air entering the main air flow sensor 30 and the main tunnel assembly 40. Referring to FIG. 3, the bell-shaped exit opening 28 may be seen. The bell-shaped exit opening 28 funnels the air into the main air flow sensor 30 and the main tunnel assembly 40 in a manner that preserves the homogeneity of the air mass. Classical flow analysis shows that a bell shaped entrance into a pipe minimizes system losses with respect to pressure drop and produces a nearly uniform velocity profile at the beginning of the pipe, i.e. the end of the converging cross-section of the bell shape. The flow profiles upon exit are smooth and the pressure losses are minimal. The uniform and regular velocity profile provides for consistent sampling and measurements.

The bell shaped exit opening 28 attaches to the main flow sensor 30 by means of a conventional bolted flange, although any type of convenient air-tight fitting may be used. A second diffusion screen may be attached to the interface/settling chamber 20 at the outlet of the bell shaped exit opening 28, to help ensure a homogenous air stream as the air stream enters the main flow sensor 30, and the main tunnel assembly 40. In the preferred embodiment of the invention, a second diffusion screen is not used, but it is contemplated that a second screen could be used and attached here.

The method of attachment of any of the parts of the enthalpy tunnel 10 is unimportant to the functionality of the enthalpy tunnel 10 as a whole, although it is necessary that all fittings be leak tight. Using a fastening device that allows for ease of removal of the constituent parts eases the assembly and disassembly process. Although not incorporated into the preferred embodiment of the present invention, it is envisioned that main flow sensor 30, the main tunnel 40, and the sampling tunnel assembly 50 may be used with differing interface/settling chamber assemblies to accommodate air conditioning units with flow rates outside the range of 2500 to 10,000 CFM. Using fastening devices such as easily removable bolted flanges will facilitate adaptability.

After exiting the interface/settling chamber 20, the conditioned air stream enters the main flow sensor 30. The main flow sensor 30 is an integral device pair consisting of a flow sensor and flow transmitter. The main flow sensor 30 is a commercially available sensing unit, comprising a flow-straightener, nozzle/venturi, and array of pilot tubes. In the preferred embodiment the main flow sensor is a NPZ1000 sensor manufactured by Brandt Industries. These devices are well known in the art, but it is critical to effective sampling with the novel enthalpy tunnel to choose a flow element that produces a smooth outlet air flow profile.

Figure 4:
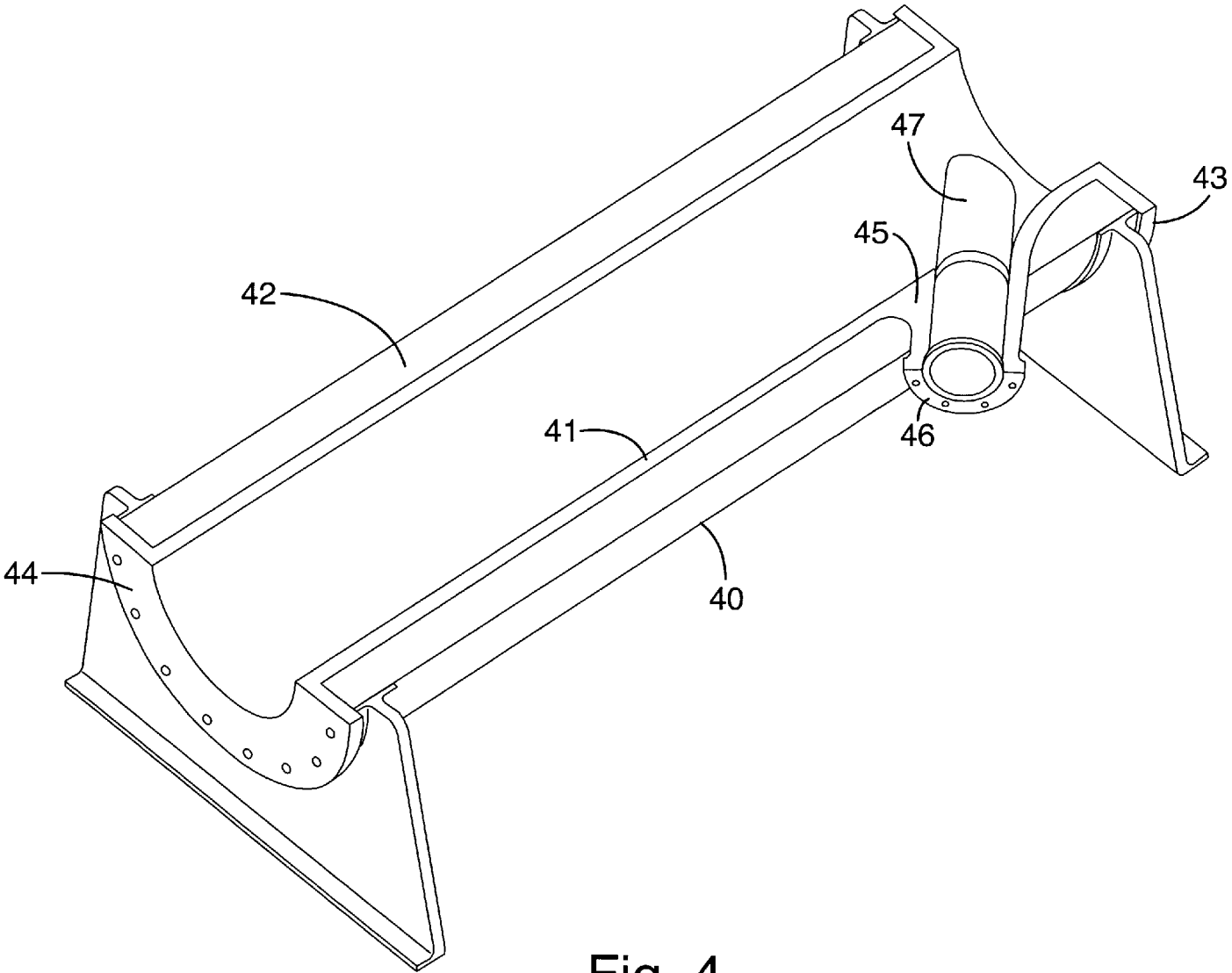
FIG. 4 is a sectional view of the main tunnel.

After exiting the main flow sensor 30, the conditioned air enters the main tunnel 40. Referring to FIG. 4, a sectional view of the main tunnel, shown generally at 40 may be seen. The main tunnel 40 comprises an inner core 41, an outer shell 42, an inlet flanged end 43, an outlet flanged end 44, and a sample tunnel connection 45. The main tunnel 40 is essentially an elongated hollow cylinder with flanged ends. The main tunnel 40 length is determined by the physical space requirements of the ancillary equipment. The shape and length of the tunnel after the point where the air stream is sampled is unimportant, and its shape and length is dictated by engineering concerns. The width of the unit as a whole is minimized to allow it to pass through equipment doors. In the preferred embodiment, this restriction dictates that the main blower assembly 80 and sampling tunnel assembly 50 cannot be side-by-side. However, alternate configurations are possible where size and shape are not problematic.

Figure 5:
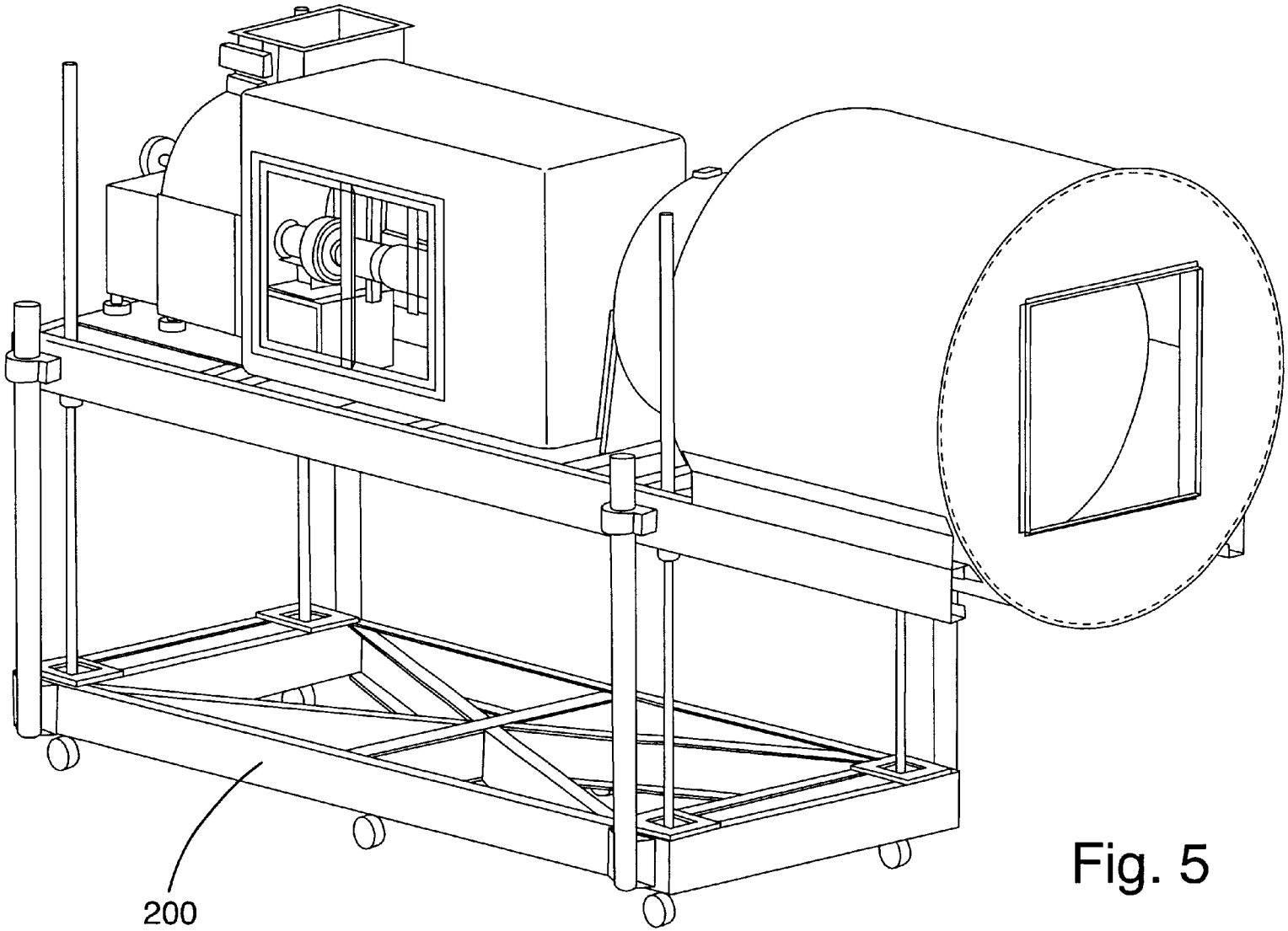
FIG. 5 is a schematic of the enthalpy tunnel and its support structure.

Referring to FIG. 5, the enthalpy tunnel 10 and its support structure may be seen indicated generally at 200. It is a point of novelty of the present invention that the enthalpy tunnel 10 is relatively portable and adaptable to various test unit configurations. In the preferred embodiment, the support structure 200 is fabricated from aluminum, but any material providing the necessary structural strength would suffice. The support structure 200 is also mounted on wheels for mobility, and includes vertical adjustment means for aligning the enthalpy tunnel 10 with air conditioning unit outlet ducting of various heights. In the preferred embodiment, the vertical adjustment means are jack screws, but alternate lifting means such as scissors lifts or hydraulic or pnematic cylinders would suffice.

The main tunnel 40 length could be lessened by reducing (as possible) the length of the sampler section. The diameter of the main tunnel 40, while directly impacting the Reynolds Number associated with the air stream in the main tunnel 40, is derived from the diameter of the main flow sensor 30. The main flow sensor 30 is sized for the required maximum flow rate, in the case of the preferred embodiment, 10,000 SCFM. The Reynolds Number depends, primarily, on the viscosity and velocity of the air, and the main tunnel 40 diameter. Length of the main tunnel 40 is not a factor.

Referring again to FIG. 4, the sample tunnel connection 45 may be seen. The sample tunnel connection 45 consists of an elongated cylindrical extension of the wall of the main tunnel 40 set at approximately 45 degrees to the longitudinal axis of the main tunnel 40, connecting to the central hollow area of the main tunnel 40 via an opening through the wall of the main tunnel 40. The angle of the sample tunnel connection 45 to the longitudinal axis of the main tunnel 40 is important in that the shallower the angle, the less perturbation to the air flow stream as it enters the sampling tunnel assembly 50. The 45 degree angle used in the preferred embodiment is a compromise between the overall length of the enthalpy tunnel 40 and acceptable perturbation to the flow stream. In general, the shallower the angle a sampling connection makes with a tunnel the longer the unit as a whole must be. The construction of the main tunnel 40 following the main flow sensor 30 and the acquisition of sample air do not affect the measurements obtained. It is necessary to accurately measure the air flow in the main tunnel 40, and to separate a representative sample of air for measurement of the wet and dry bulb temperatures. Perturbation of the air stream after the sample is taken does not affect the accuracy of the measurements. In the preferred embodiment, the sample tunnel connection 45 is constructed integrally with the main tunnel 40 and has at its termination a flanged connection 46. The flanged connection 46 allows the main tunnel 40 to be connected to the sampling tunnel assembly 50. Alternative embodiments contemplate a sample tunnel integrally molded with the main tunnel 40.

As the air exits the main sensor 30 and starts down the main tunnel 40 a portion of the air stream encounters a diverter tube 47 that extends into the main tunnel 40. Referring to FIG. 4, the diverter tube 47 may be seen. The diverter tube 47 is an elongated cylindrical tube that enters the main tunnel 40 with its longitudinal axis parallel to the longitudinal axis of the sample tunnel connection 45. The diverter tube 47 extends approximately one third of the main tunnel 40 diameter into the main tunnel 40. In the preferred embodiment of the invention, the end of the diverter tube 47 furthest into the main tunnel 40 is cut at an angle of 67.5 degrees from its longitudinal axis. There is no specific diameter required for the diverter tube 47. In general, the diameter of the diverter tube 47 is such that the diverter tube outside diameter matches the inside diameter of the sampling tunnel assembly 50. Because perturbation of the air flow behind the diverter tube 47 in unimportant to the accuracy of the measurements, the diameter of the diverter tube 47 is selected to provide a sufficient sample that can be controlled in velocity to 1000 fpm.

A large negative pressure exists behind the main flow sensor 30, caused by acceleration of the air through the main flow sensor 30, which has a internal nozzle. The diverter tube 47 is located in the main tunnel 40 just behind the outlet of the main flow sensor 30. In this region, the local velocity is high, hence a low local pressure exists. The diverter tube 47 acts like a Pitot-static tube. The dynamic pressure in the main tunnel 40, which is a function of the air velocity squared, is used to generate a local stagnation pressure at the inlet of the diverter tube 47, which is then overcome by a sampler blower 70 which may be seen by reference to FIG. 6.

The location of the opening of the diverter tube 47 is necessary, as stated above, to prevent a negative static pressure that could not be overcome by the sampler blower 70. The main flow sensor 30 includes an integral nozzle that accelerates the air. The resulting exit air flow is analogous to small air jet in the middle of a larger area where the flow around the edges of the jet swirl back. This backswirl creates a negative pressure. Inserting the diverter tube 47 opening into this jet overcomes the negative pressure. The geometry of the diverter tube 47 tip is the result of a series of tests -measuring the static pressure induced in the diverter tube. The 67.5 angle used in the preferred embodiment gives the highest (least negative) static pressure at the inlet of the diverter 47.

The diverter tube 47 converts the dynamic pressure in the main tunnel 40 into a local static pressure at the diverter tube 47 inlet that is close to zero gauge. This allows the air to be pulled into the sampling tunnel assembly 50 by the sample blower assembly 70 at a rate sufficient to meet the ASAE requirement of 1000 fpm. Without the diverter tube 47, the pressure in the main tunnel 40 is low enough that air cannot be pulled into the sampling tunnel assembly 50 over the entire operating range of the machine, 2500–10,000 SCFM.

Figure 6:
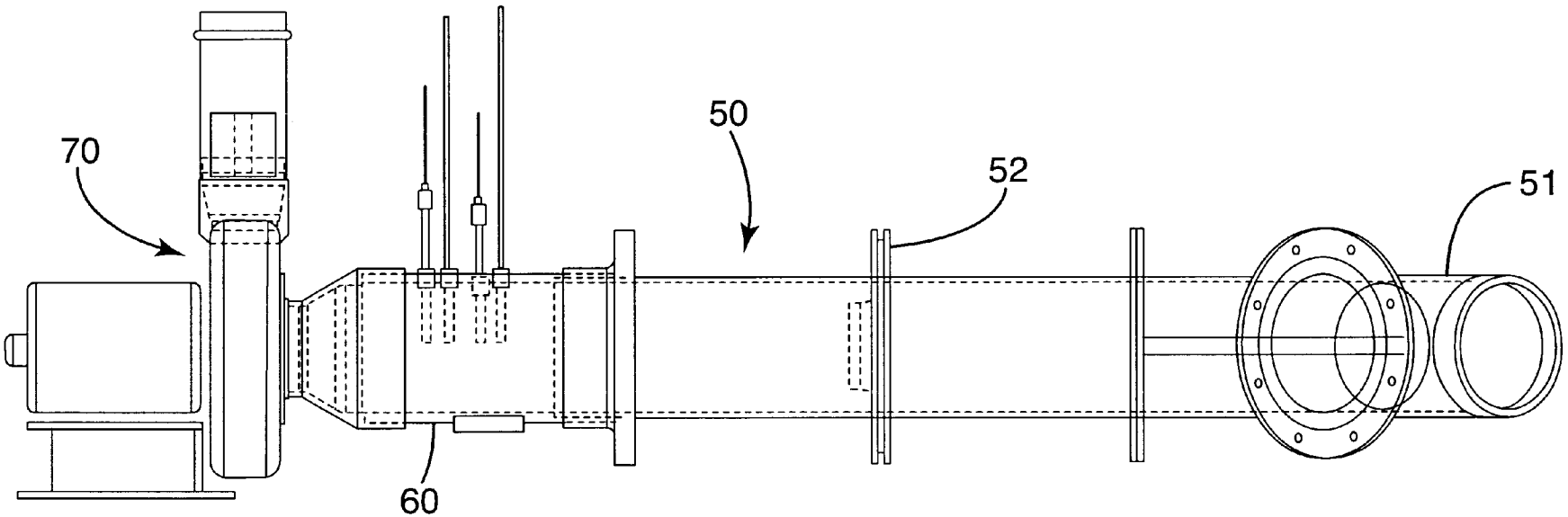
FIG. 6 is a schematic of the sampling tunnel.

Referring now to FIG. 6, the sampling tunnel assembly may be seen, indicated generally at 50. The sampling tunnel assembly 50 comprises a transition connector 51, a sampling air flow sensor 52, a sampler tube sub-assembly 60, and the sampling blower assembly 70. In the preferred embodiment of the present invention, the transition connector 51 is a flanged 45 degree elbow. The shape and dimensions of the transition connector 51 itself are not essential to the overall operation of the enthalpy tunnel 10, nor of the sampling tunnel 50. However, it is part of the inventive quality of the present invention to provide a sampling mechanism that conditions the sampled air, creating in the sample volume a uniform and consistent velocity profile. In this regard, the sampling tunnel 50 is designed to minimize the number and severity of piping bends, and use a substantially circular geometry. The sampling tunnel 50 is designed to minimize the disruption to the air flow, and to allow the sampling tunnel assembly 50 to be close to and parallel to the main tunnel 40.

In contrast to the other parts of the enthalpy tunnel 10, the sampling tunnel assembly 50 is un-insulated, and is maintained at the same temperature as the air being sampled. It is desirable to construct the sampling tunnel 50 from materials that reach equilbrium temperature with the surrounding air quickly. This minimizes the time the tunnel must "soak" prior to taking data. The sampling tunnel assembly 50 is enclosed in an insulated enclosure (not shown) which surrounds the sampling tunnel assembly 50. Air from the conditioned air volume being tested is drawn from the main tunnel 40, passed through the sampling tunnel assembly 50, and is exhausted into the insulated enclosure. At the beginning of a test, the air conditioning unit under test is allowed to run, air is pulled through the sampling tunnel assembly 50 by the sampling blower assembly 70, exhausting to the insulated enclosure. The sampling tunnel assembly 50 is then allowed to come to an equilibrium temperature, as indicated by a temperature that is stable and within +/−0.1 degrees Fahrenheit with the sampled air, before data is collected. Keeping the sampling tunnel assembly 50 close to and parallel to the main tunnel 40 is an efficient method of keeping the enthalpy tunnel 10 as a whole, compact and easier to cool than a larger unit, and as stated above, capable of being transported through standard door openings.

Referring again to FIG. 6, the sampling air flow sensor 52 may be seen. The sampling air flow sensor 52 is similar to the other air flow measuring devices previously described in this specification. A flow transmitter (the two devices, sensor and transmitter, are purchased as a matched pair) is appropriately attached to the sampling air flow sensor 52 so that the air volume passing through the sampling tunnel assembly may be accurately measured. These types of devices are well known in the art and are not critical to the inventive qualities of the present invention except for their exit profile qualities as mentioned above. After exiting the sampling air flow sensor 52, the air stream enters the sampler tube sub-assembly 60.

Figure 7:
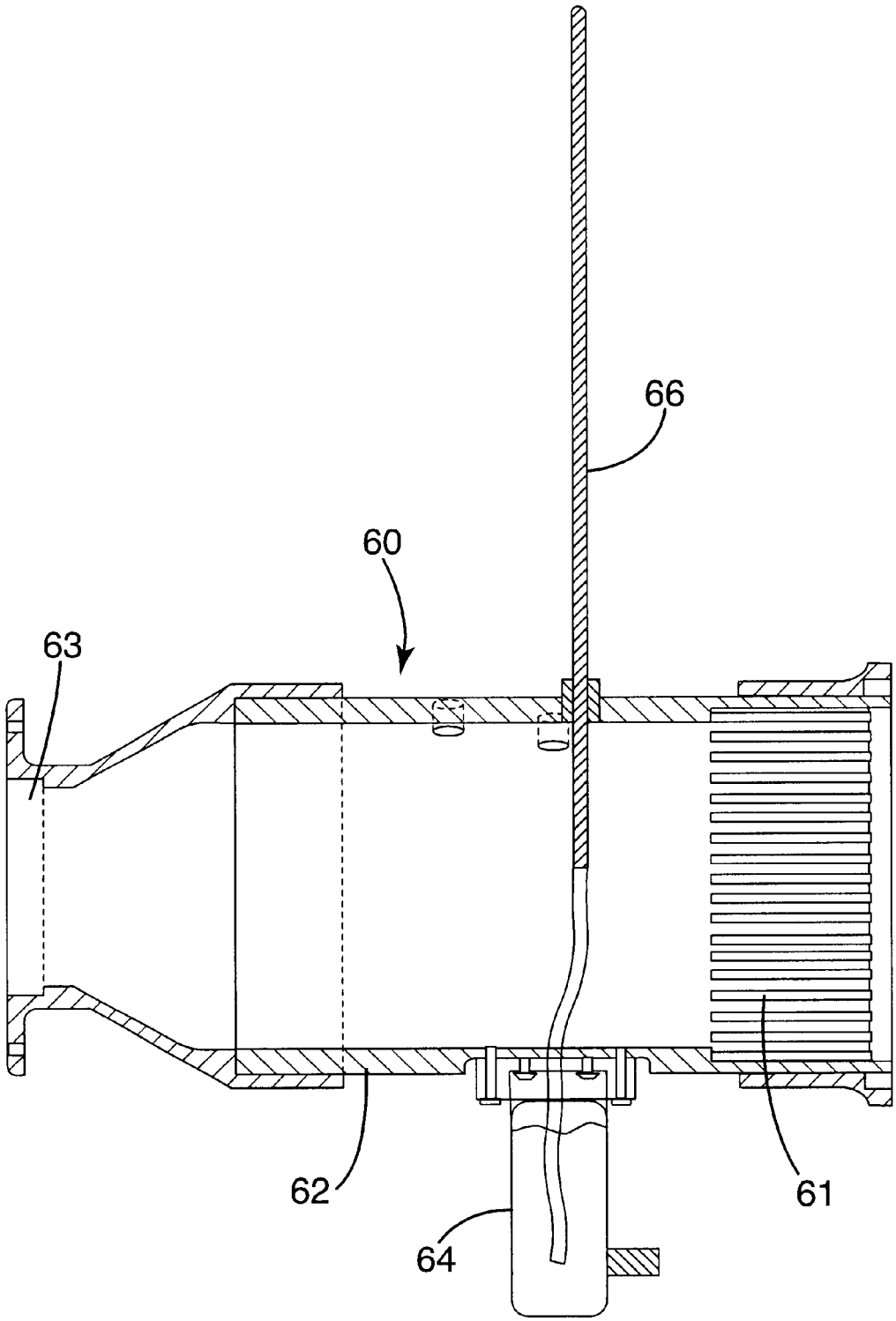
FIG. 7 is a schematic of the sampling tunnel instrumentation section.

Referring to FIG. 7, the sampler tube sub-assembly 60 may be seen. The sampler tube sub-assembly 60 comprises a flow straightening element 61, a sampling tube 62, a discharge nozzle 63, and a water cup 64. The flow straightening element 61 is an elongated cylindrical thin walled honeycombed structure. In the preferred embodiment the flow straightening element 61 is a honeycomb core of polycarbonate such as a Plascore model PCFR250W6.000-2. This particular flow straightening element has honeycomb channels approximately ¼ inch flat to flat measurement. The flow straightening element 61 approximates an array of long small tubes and serves to mitigate any swirling motion within the air stream. The size of the channels and the length of the element 61 must be chosen so as to avoid excessive back pressure, and still mitigate nearly all swirling. In the preferred embodiment, the flow straightening element 61 is 6 inches in length and 6.25 inches in diameter however, other dimensions may be employed as calculations so dictate.

After passing through the flow straightening element 61, the air stream passes into the sampling tube 62. The resultant air stream within the sampling tube 62 is a completely turbulent moving air volume with a flat parabolic velocity profile. Although not included in the present embodiment, it is contemplated that future designs of the sampling system will include a fine diffusion screen in the air stream to help scrub any wall effects within the sampling region. The local differential pressure gradients within the sampling tube 62 across any cross section of the sampling tube 62 are at or very close to zero. This type of air stream is necessary to ensure accurate and repeatable test results.

Referring again now to FIG. 7, the sampler tube sub-assembly 60 with the associated instrumentation may be seen. In the preferred embodiment of the present invention and in enthalpy tunnels in general, there are three instruments in the sensing section of the sampling assembly 50: a dry bulb measuring device 65; a wet bulb measuring device 66, and a differential pressure transmitter 67. The dry bulb measuring device 65 utilizes a 100 Ω Plinum Bulb RTD, 4 wire configuration, with a high-accuracy transmitter. The RTD sensor has a sheath, but the tip is perforated so that the air stream can directly impinge the platinum element. The wet bulb RTD sensor is identical to the dry bulb, except that the tip of the probe is not perforated. This is eliminates the possibility that the water would short the platinum element. The dry bulb RTD and wet bulb RTD use identical transmitters. The source of the water for the wet bulb RTD is a wick that covers the entire length of the sensor element inside the sampler tube sub-assembly 60. The other end of the wick is in the water cup 64 which is maintained full of water by a water reservoir system described in full below.

A draft-range (0–6 inches of water column differential pressure transmitter 67 provides information on the local static pressure inside the sampler tube sub-assembly 60 to provide a measurement for compensating for the atmospheric pressure utilized in the enthalpy calculations. The instrumentation is sealed in the sampler tube sub-assembly 60 by modified (enlarged center bore) laboratory beaker stoppers that interface with mated (same angle) conical holes through the wall of the sampling tube 62. A barometric pressure transmitter 68, is included as part of the sampling tunnel 50 instrumentation, providing an input for calculations.

A water reservoir is used to maintain the water cup 64 filled during testing. The water reservoir 80 is contained within the insulated enclosure housing the sampling tunnel 50. The temperature of the water is maintained at virtually the same temperature as the conditioned air. This is important for good wet bulb temperature readings as a water temperature different from the air temperature would affect the wet bulb measurement.

Figure 8:
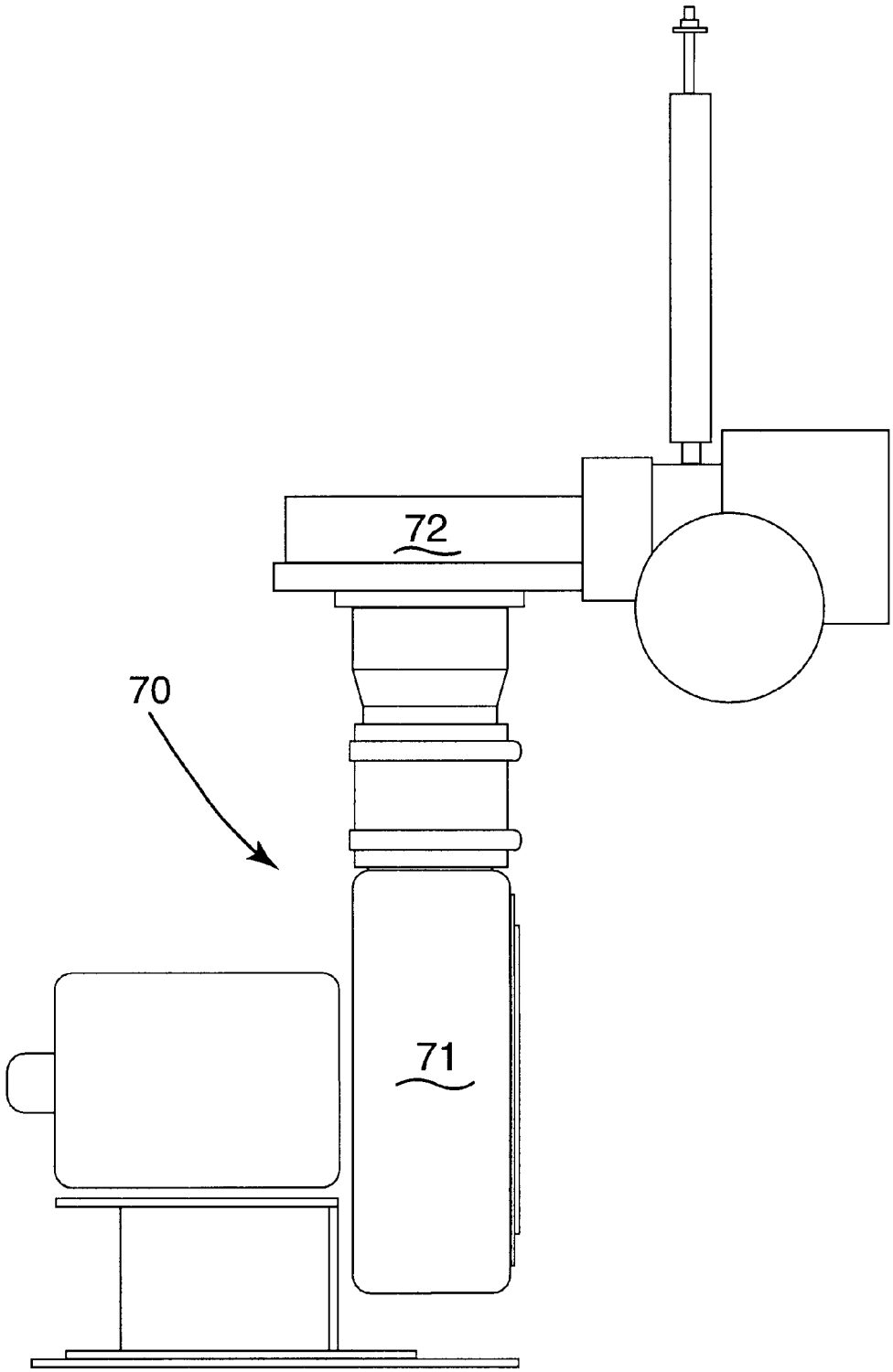
FIG. 8 is a schematic of the sampler blower sub-system.

Referring now to FIG. 8, the sample blower assembly may be seen, indicated generally at 70. The sample blower assembly 70 comprises a blower motor and fan 71, transitional/connective piping, and a motor operated discharge damper 72. The blower motor and fan 71 provide a constant discharge flow rate from the sampling tunnel assembly 50. The discharge damper 72 controls the velocity of the air through the sampling tunnel 50. Both the blower motor and fan 71, and the discharge damper 72 are controlled by a loop control system 100, which will be described below.

The Air Speed and Mass Flow Rate Control System

Figure 9:
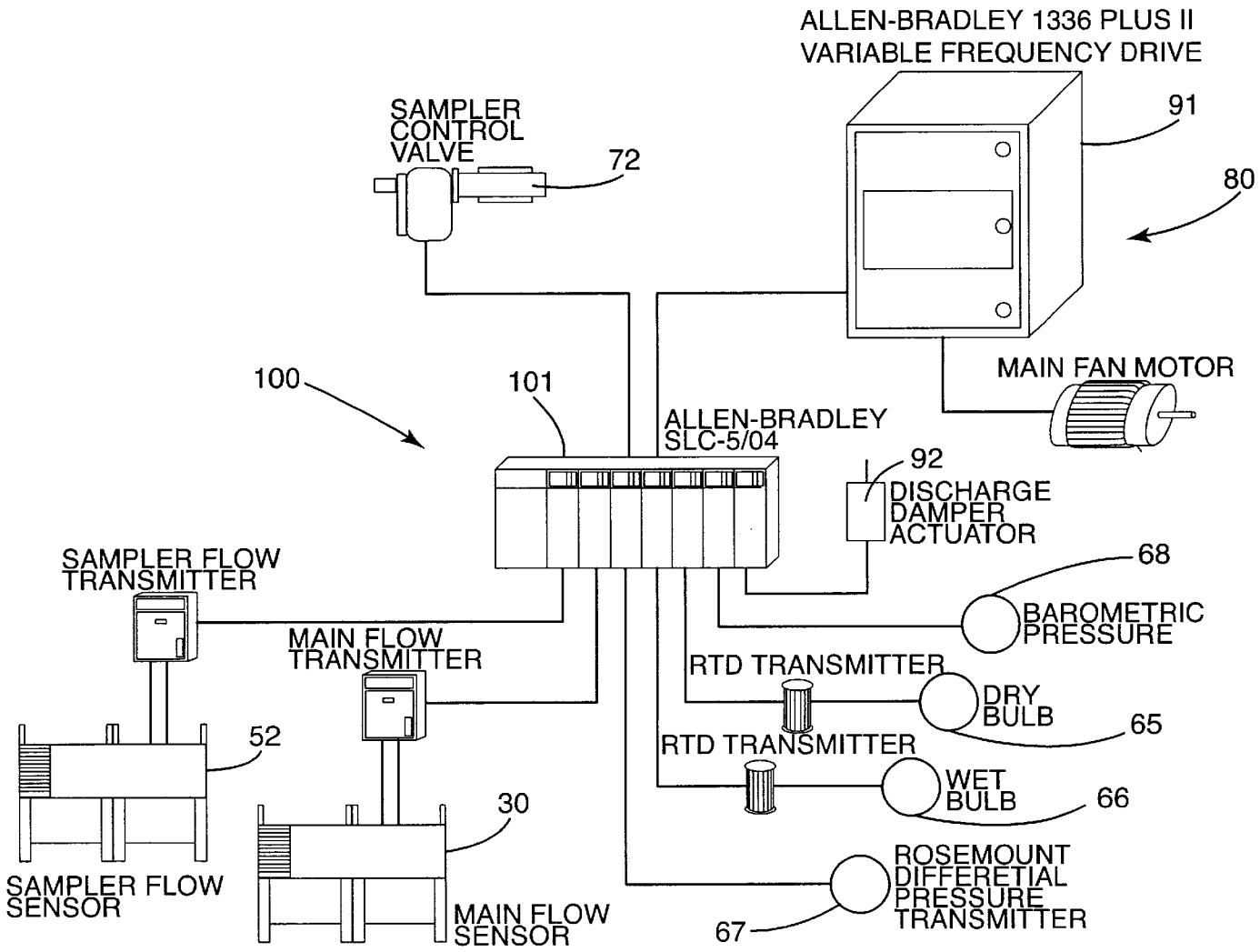
FIG. 9 is a block diagram of the control system.

Referring to FIG. 9, a schematic of the loop control system may be seen, indicated generally at 100. The loop control system 100 is designed with a microprocessor-based, real-time data acquisition and control system. In the preferred embodiment, the data acquisition and control system is an Allen Bradley SLC 5/04 Programmable Logic Controller (PLC) 101, although other PLC's may be used and the use of a particular controller is not critical to the invention. Programmable Logic Controllers are commercially available units well known in the art. PLC's can be programmed with closed-loop algorithms as in the preferred embodiment. They normally come equipped with instrumentation interfacing and provide for communication with Supervisory Control Systems which may be used to operate a test cell. The Supervisory Control System and the test cell are not aspects of the present invention, but are typical components used in enthalpy testing environments. In the preferred embodiment, the PLC is used to provide deterministic control of the actuators and drivers. The deterministic control algorithm used in the present invention is part of its inventive quality, and will be described in detail later in this specification.

Main Tunnel Air Mass Flow Rate Control

The sensors and actuators used on the enthalpy tunnel 10 provide input to and are controlled by the loop control system 100. The mass flow rate of air through the main tunnel 40 is a parameter that must be closely controlled. The loop control system provides a positive deterministic control that continually monitors the mass flow rate using a single flow element, and adjusts the discharge rate of the main blower assembly 80 as necessary to maintain a constant mass flow rate.

Referring again to FIG. 9, the main blower assembly indicated generally at 80 comprises a variable frequency drive 91 which in turn drives a fan/motor unit, a discharge damper actuator 92 which controls a discharge damper, and a housing and support structure. The PLC 101 performs a real-time, approximate Standard CFM compensation used for closed-loop control of the mass flow rate through the main tunnel 40, using inputs from the main flow sensor 30, the calculated wet bulb and calculated dry bulb temperatures. A closed loop control program adjusts the frequency of the electrical supply to variable frequency drive 91 thereby controlling the speed and the discharge rate of the connected fan. Alternatively, the position of the discharge damper 92 may be varied, or a combination of controlling both the main blower 80 and the discharge damper can be used to maintain the desired mass flow rate of air through the main tunnel 40. In the preferred embodiment, the discharge damper 92 is used when an air conditioning unit under test has its own discharge fan, and has a low output flow of air.

The mass flow rate of air is determined by measuring the humidity and temperature of the air, and its velocity through the main tunnel. Flow sensors 30 and 52 utilize an array of pitot sensors to generate a differential pressure signal proportional, via square-root extraction, to the velocity of air in the sensor. The sensor pressure ports are connected to flow transmitters which convert the pressure to a current loop (4–20 mA) signal proportional to the volumetric flow rate through the sensor. These current loop signals are wired to input modules on the PLC 101. The temperature and humidity of the air volume are measured by the instrumentation in the sampling tunnel 50, and input to the PLC 101. The sampling tube 62 three different sensors. There are two different temperature readings and a differential pressure reading. The pressure differential sensor 67 is a draft-range (0–6 $INH_2O$) pressure transmitter with the high pressure port open to atmosphere and the low pressure port connected to the clear sampler sensor section 60. The pressure sensor 67 is equipped with a transmitter that generates a current loop (4–20 mA) signal proportional to the pressure and is also connected to an input module on the PLC 101. This sensor provides a local correction, relative to the Barometric pressure, at the sensing location. There are also two 4 wire, 100 Ω Platinum Bulb RTD sensors. One reports the Dry Bulb (actual) temperature (item 65), and the tip of the probe is perforated to allow air to directly impinge the RTD element. The other reports the Wet Bulb temperature (item 66) and the tip is not perforated. Instead, it is covered by a sock. The other end of the sock is in a reservoir of water, the water cup 64, described above. The cables (4 wires, each) are connected to temperature transmitters specifically calibrated to the sensor it is paired with. The transmitter generates a current loop (4–20 mA) signal proportional to the programmed temperature range of the transmitter.

Sampling Tunnel Air Velocity Control

The air velocity through the sampling tunnel assembly 50 is maintained at 1000 fpm +/−10 fpm by a closed loop control program in response to a signal generated by the sampling tunnel flow sensor 52. The sampler flow sensor signal, generated by the sample flow element 52, is divided by the area of the sensing section of the sampler tube assembly 50 to determine the velocity of the air stream.

Figure 10:
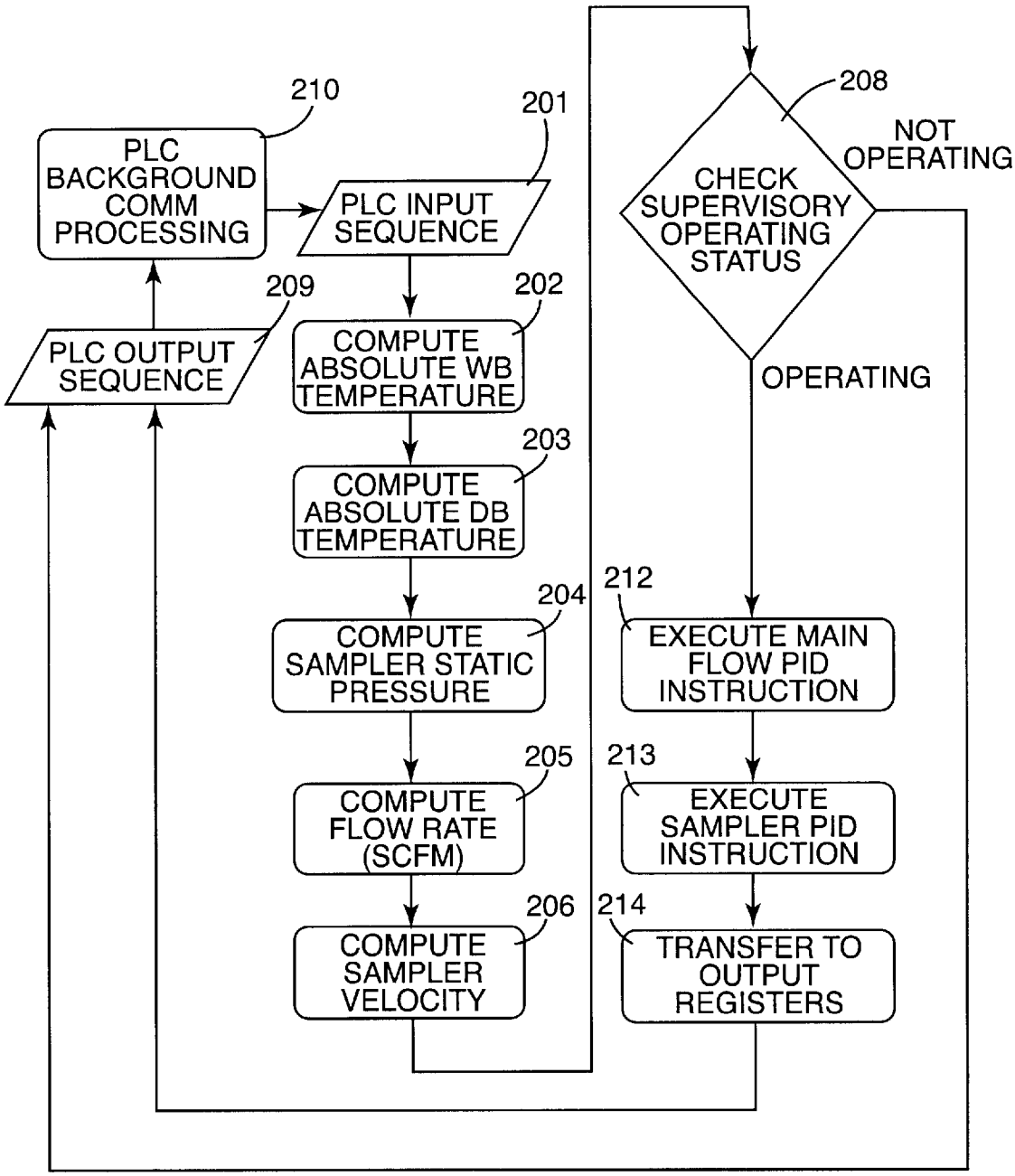
FIG. 10 is a block diagram of the control algorithm.

Referring to FIGS. 7 and 10, the sampling tunnel 50 has a fixed-speed blower fan 71 with a control valve 72 functioning as a flow control damper as described above. In the sampling tunnel 50, an actual flow rate ACFM of air as calculated by the controller 101 using the (differential pressure) indicated by the sampling tunnel flow sensor 52 is converted into a velocity. A closed loop control algorithm in the controller 101 compensates for changes in velocity, as indicated by the flow sensor 52, by selectively opening or closing the control valve 72. The velocity of air in the sampling tunnel 50 is maintained at a velocity of 1000 fpm (+/−10) for a valid standard wet bulb measurement.

The closed loop feedback control system 100 is an integral part of the overall enthalpy tunnel 10 design. By varying blower speeds and controlling back-pressure to achieve the desired flow rates, the controller 101 allows the enthalpy tunnel 10 to meet any flow conditions necessary to accurately and consistently determine the rating of air conditioning units that operate in the 500–20,000 SCFM range. The overall applicable range of the control system will cool flow rates from 500–20,000 SCFM, however, the preferred embodiment of the enthalpy tunnel 10 operates in the 2500–10,000 SCFM range.

Closed Loop Control Algorithm

As mentioned above, the PLC may be programmed by the user to perform a variety of calculations and provide output control signals. It is an aspect of the present invention that the enthalpy tunnel 10 is equipped with a loop control system and that the system incorporates a unique control algorithm. Internally, there are two major calculations performed by the loop control program in real time. Referring to FIG. 10, a flow diagram of the loop control system algorithm may be seen. In general, the main tunnel flow rate as measured in ACFM is modified to a standard flow rate (SCFM) which is equivalent to a mass flow rate, and the main blower assembly 80 is controlled to maintain a mass flow rate.

The PLC 101 receives input from the main flow sensor 30, the sample tunnel flow sensor 52, the dry bulb RTD 65, the wet bulb RTD 66, the differential pressure transmitter 67, and the barometric pressure transmitter 68. These are continuous analog inputs to the PLC 101, and are represented on FIG. 10 as the PLC input Sequence 201. The PLC then computes an absolute wet bulb temperature 202, an absolute dry bulb temperature 203, the sampling tunnel static pressure 204, the main flow rate 205, and the air stream velocity in the sampling tunnel 206. The flow rate (ACFM) is multiplied by the cross-sectional area of the sampler to generate the air velocity at the sensor section.

The status of the Supervisory Operating System 208 is then determined. As discussed above, the Supervisory Operating System is external to the enthalpy tunnel 10 and the merely provides signals to start and stop a test run. If the Supervisory Operating System is sending a stop signal, the PLC will send a signal to its outputs indicated at 209, to shut down or not start the enthalpy tunnel equipment. Communication to the enthalpy tunnel equipment is indicated as PLC Background Comm Processing, block 210. If the Supervisory Operating System is operating, then the computed values are sent to the output portion of the algorithm.

There are two closed-loop control schemes in the output algorithm. Each uses the internal PID (Proportional/Integral/Derivative) instruction that is a part of the Allen Bradley software for the SLC 5/04 used in the preferred embodiment. PID controllers are well known in the art.

The first output algorithm loop 212 compares the Main Tunnel Standard Flow Rate (SCFM) computed at 205, to a setpoint downloaded from the supervisory operating system. As the flow deviates from the setpoint, the speed of the main blower assembly 80 is adjusted to bring it back to the setpoint. The second output algorithm loop 213 compare the calculated sampler velocity 206 to a fixed setpoint. In the preferred embodiment, this is 1000 ft/min. As the calculated and velocity deviates from 1000, it will open or close the control valve 72, accordingly, to bring the velocity back to 1000. Both signals are then transferred to output registers 214, integral to the PLC 101, and then to the PLC output 209.

We claim:

1. An enthalpy tunnel for receiving a mass flow rate of conditioned air comprising:

a settling chamber of substantially circular cross section having an inlet, a single aerodynamically smooth bell-shaped outlet, and an air settling and mixing volume disposed therebetween, a main tunnel attached to said bell-shaped outlet and disposed so as to accept the conditioned volume of air from said outlet, said tunnel comprising:

an inlet end attached to said flow sensor disposed so as to receive the air stream from said flow sensor, a discharge end, a hollow body interposed between said ends, a sampling connection forming an opening through said hollow body, a sampling tunnel connected to said sampling connection disposed so as to divert and capture an air sample from said main tunnel, and a flow sensor and transmitter interposed between said bell-shaped outlet and said main tunnel for generating a signal proportionate to the flow rate of said conditioned volume of air.

2. The device as recited in claim 1 wherein said main tunnel further comprises:

a variable-rate blower attached said discharge end disposed so as to pull an air volume through said main tunnel and said settling chamber.

3. The device as recited in claim 2 wherein said variable rate blower comprises:

a discharge damper, and actuator means for positioning said discharge damper.

4. The device as recited in claim 2 wherein said variable rate blower is controlled to maintain the desired mass flow rate through said main tunnel.

5. The device as recited in claim 3 wherein said actuator means is controlled to position said damper to maintain a desired mass flow rate through said main tunnel.

6. The device as recited in claim 2 wherein said variable rate blower is controlled to maintain a static pressure at said inlet of said settling chamber.

7. The device as recited in claim 3 wherein said actuator means is controlled to position said damper to maintain the static pressure at said inlet of said settling chamber.

8. The device as recited in claim 1 wherein said settling chamber further comprises a single diffusion screen disposed within said settling and mixing volume.

9. The device as recited in claim 1 wherein said settling chamber further comprises a plurality of diffusion screens disposed within said settling and mixing volume.

10. The device as recited in claim 1 further comprising a support structure allowing vertical and horizontal adjustment.

11. The device as recited in claim 1 wherein said sampling tunnel further comprises:

an inlet end for diverting and capturing of volume of air from a moving air stream;

a discharge end; a hollow body interposed between said inlet end and said discharge end forming a closed surface; a flow sensor integral with said hollow body and disposed adjacent to said inlet end; a flow straightening device integral with said hollow body and disposed downstream of said flow element, and means for measure the physical characteristics of said volume of air attached to said hollow body downstream of said flow straightening device.

12. The device as recited in claim 11 wherein said sampling tunnel further comprises:

means for maintaining a constant air velocity said sampling tunnel attached to said outlet of said hollow body.

13. The device as recited in claim 12 wherein said means for maintaining a constant air velocity comprise:

a discharge blower attached to said discharge end and disposed so as to draw an air volume through said sampling tunnel and discharge it to the atmosphere, a discharge damper disposed between said discharge blower and the atmosphere, and actuator means attached to said damper for positioning said damper.

14. The device as recited in claim 13 further comprising:

a closed loop control system for controlling a mass flow rate in a first system and velocity flowrate in a second system comprising:

a first input signal from a first flow transmitter;

the second input signal from a dry bulb temperature instrument;

a third input signal from a wet bulb temperature transmitter, a fourth input signal from a barometric pressure transmitter;

the fifth input signal from a second flow transmitter;

a programmable controller comprising a central processing unit for storing program instructions, receiving data input and generating output signals, and having means for calculating a mass flow rate from said first, second, third and fourth inputs and a velocity from said fifth input.

15. The device as recited in claim 14 wherein said programmable controller generates a first output signal for controlling said enthalpy tunnel discharge blower, and a second output signal for controlling said sample tunnel discharge blower.

16. The device as recited in claim 15 wherein said enthalpy tunnel discharge blower is a fan driven by a variable frequency drive, and said sample tunnel discharge blower comprises a fan coupled with a motor, a discharge damper, and damper actuator means.

17. A processing algorithm for use in a programmable controller for determining and controlling the mass flow rate of a first body of air and the velocity of the second body of air in real-time, comprising:

means for real-time determination of the humidity of said first and second bodies of air;

means for real-time determination of the temperature of said first and second bodies of air;

means for real-time determination of the flow rate of said first body of air;

means for real-time determination of the flow rate of said second body of air;

means for calculating the mass flow rate of said first body of air using said real-time determinations of humidity, temperature and flow rate;

means for calculating the velocity of said second body of air using said real-time determinations of humidity, temperature and flow rate;

means for providing a first output value to be used by said programmable controller to manipulate an actuator or driver to maintain the mass flow rate of said first body of air at a desired setpoint, and means for providing a second output value to be used by said programmable controller to manipulate an actuator or driver to maintain the velocity of said second body of air.

18. The device as recited in claim 17 wherein said algorithm is used to control an enthalpy tunnel and an associated sampling tunnel.

19. The device as recited in claim 17 wherein said closed loop control system further comprises means for interfacing and accepting control signals from a supervisory control system.

* * * * *